US008440111B2

(12) United States Patent
Chen et al.

(10) Patent No.: US 8,440,111 B2
(45) Date of Patent: May 14, 2013

(54) LEAD-FREE CONDUCTIVE PASTE COMPOSITION

(75) Inventors: Rong-Zhi Chen, Kaohsiung (TW); Hung-Shuo Chung, Kaohsiung (TW); Chin-Lin Huang, Kaohsiung (TW); Jye-Long Lee, Kaohsiung (TW); Shu-Hua Chen, Kaohsiung (TW); Jui-Tung Chang, Kaohsiung (TW)

(73) Assignee: China Steel Corporation, Kaohsiung (TW)

( * ) Notice: Subject to any disclaimer, the term of this patent is extended or adjusted under 35 U.S.C. 154(b) by 142 days.

(21) Appl. No.: 13/109,525

(22) Filed: May 17, 2011

(65) Prior Publication Data

US 2012/0168689 A1 Jul. 5, 2012

(30) Foreign Application Priority Data

Dec. 30, 2010 (TW) ..... 99146910 A

(51) Int. Cl.
*H01B 1/16* (2006.01)
*H01B 1/22* (2006.01)

(52) U.S. Cl.
USPC ..... 252/512

(58) Field of Classification Search ..... 252/512
See application file for complete search history.

(56) References Cited

U.S. PATENT DOCUMENTS

| | | | | |
|---|---|---|---|---|
| 5,354,969 | A * | 10/1994 | Akiyama et al. | 219/541 |
| 8,076,570 | B2 * | 12/2011 | Salami et al. | 136/256 |
| 2010/0059116 | A1 | 3/2010 | Brenner et al. | |
| 2012/0174974 | A1 * | 7/2012 | Khadilkar et al. | 136/256 |

FOREIGN PATENT DOCUMENTS

CN 1877864 A 12/2006

* cited by examiner

*Primary Examiner* — Mark Kopec
(74) *Attorney, Agent, or Firm* — Caesar, Rivise, Bernstein, Cohen & Pokotilow, Ltd.

(57) ABSTRACT

A lead-free conductive paste composition includes silumin powder, lead-free glass frits, an organic binder, stearic acid zinc, and aluminum powder.

5 Claims, 1 Drawing Sheet

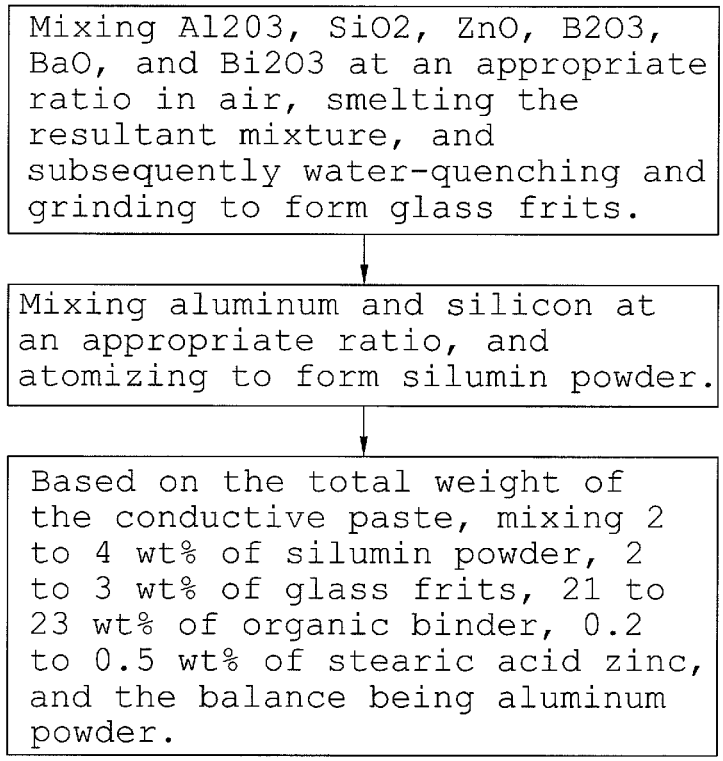

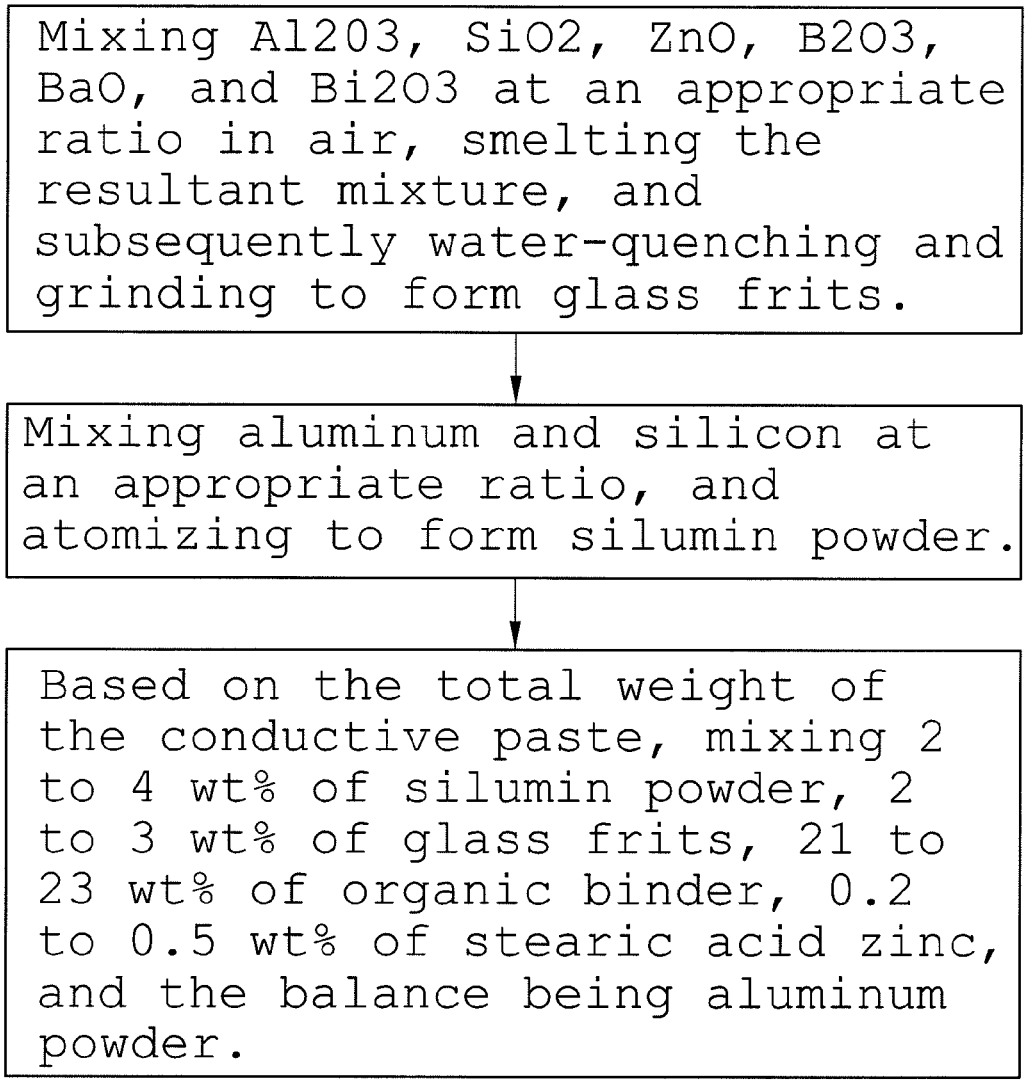
Mixing Al2O3, SiO2, ZnO, B2O3, BaO, and Bi2O3 at an appropriate ratio in air, smelting the resultant mixture, and subsequently water-quenching and grinding to form glass frits.
Mixing aluminum and silicon at an appropriate ratio, and atomizing to form silumin powder.
Based on the total weight of the conductive paste, mixing 2 to 4 wt% of silumin powder, 2 to 3 wt% of glass frits, 21 to 23 wt% of organic binder, 0.2 to 0.5 wt% of stearic acid zinc, and the balance being aluminum powder.

LEAD-FREE CONDUCTIVE PASTE COMPOSITION

CROSS-REFERENCE TO RELATED APPLICATION

This application claims priority of Taiwanese application no. 099146910, filed on Dec. 30, 2010.

BACKGROUND OF THE INVENTION

1. Field of the Invention

This invention relates to a lead-free conductive paste composition, more particularly to a lead-free conductive paste composition used to form a back electrode of a solar cell.

2. Description of the Related Art

At present, a back electrode of a solar cell, particularly poly-silicon solar cells, is formed by screen printing and firing a conductive paste, e.g., an aluminum paste or a silver paste, on silicon wafers. Due to different thermal contraction between the silicon wafer and the conductive paste, a bowing phenomenon would likely occur after a high-temperature firing process.

Chinese patent application publication no. 1877864A discloses a conductive slurry composition and a method for producing the same. In this application, the conductive slurry composition includes aluminum powders, a modified organic binder, an inorganic binder, and glass metal powders. Since the aforesaid glass metal powders contain up to 50 wt % of lead oxide, the composition does comply with the EU RoHS Directive.

US patent application publication no. 2010/0059116 A1 discloses an aluminum paste comprising particulate aluminum and an organic vehicle. The particulate aluminum includes 30 to 90 wt % of spherical-shaped aluminum powder and 10 to 70 wt % of nodular-shaped (irregular-shaped) aluminum powder. Although, in this US patent application, the solar cell has reduced bowing phenomenon, due to the presence of the irregular-shaped aluminum powder, the packing density of a back electrode made from the aluminum paste is relatively loose, and the fill factor of the solar cell containing the back electrode is relatively low.

SUMMARY OF THE INVENTION

Therefore, the object of the present invention is to provide a lead-free conductive paste composition for reducing bowing phenomenon of a solar cell when the lead-free conductive paste is fired to form a back electrode of the solar cell.

According to this invention, a lead-free conductive paste composition comprises silumin powder, lead-free glass frits, an organic binder, stearic acid zinc, and aluminum powder.

A method of producing the lead-free conductive paste composition of this invention includes the following steps.

First, the lead-free glass frits are prepared by mixing $Al_2O_3$, $SiO_2$, ZnO, $B_2O_3$, BaO, and $Bi_2O_3$ at an appropriate ratio, and by air smelting the aforesaid mixture to obtain a homogeneous molten mixture, followed by water-quenching and grinding.

Then, a mixture of aluminum and silicon at an appropriate ratio is smelted to give a homogeneous molten mixture, followed by atomization to give the silumin powder.

Finally, based on the total weight of the conductive paste, 2 to 4 wt % of the silumin powder, 2 to 3 wt % of the glass frits, 21 to 23 wt % of the organic binder, 0.2 to 0.5 wt % of stearic acid zinc, and the balance being the aluminum powder are mixed to give the lead-free conductive paste composition.

BRIEF DESCRIPTION OF THE DRAWING

The above and other features and advantages of the present invention will become apparent in the following detailed description of the preferred embodiments with reference to the accompanying drawing, in which:

FIG. 1 is a flow chart that illustrates a method for producing the lead-free conductive paste composition of this invention.

DETAILED DESCRIPTION OF THE PREFERRED EMBODIMENTS

The present invention relates to a lead-free conductive paste composition for a solar cell including silumin powder, lead-free glass frits, an organic binder, stearic acid zinc, and aluminum powder.

Preferably, the lead-free conductive paste composition of the present invention includes, based on the total weight of the conductive paste composition, 2 to 4 wt % of the silumin powder, 2 to 3 wt % of the lead-free glass frits, 21 to 23 wt % of the organic binder, 0.2 to 0.5 wt % of stearic acid zinc, and the balance being the aluminum powder.

Based on the total weight of the lead-free glass frits, the lead-free glass frits include $Al_2O_3$, $SiO_2$, ZnO, $B_2O_3$, BaO, and $Bi_2O_3$. The proportion of the aforesaid components in the glass frits is not strictly limited. Preferably, the lead-free glass frits include, based on the total weight of the glass frits, 0.1 to 3 wt % of $Al_2O_3$, 3 to 10 wt % of $SiO_2$, 12 to 15 wt % of ZnO, 7 to 10 wt % of $B_2O_3$, 0.1 to 3 wt % of BaO, and the balance being $Bi_2O_3$.

Based on the total weight of the silumin powder, the silumin powder includes 12.6 to 99.9 wt % of silicon and the balance being aluminum powder. The silumin powder is used to effectively reduce the bowing problem of the silicon wafer attributed to volume changes when a conductive paste is screen printed and is then fired at a high temperature to form the back electrode.

Based on the total weight of the organic binder, the organic binder includes 1 to 4 wt % of polyvinyl butyral (PVB), 3 to 6 wt % of ethyl cellulose (EC), 5 to 30 wt % of butyl carbitol (BC), 20 to 45 wt % of butyl carbitol acetate (BCA), and the balance being terpineol. It should be noted that, since the aforesaid components of the organic binder do not effectively influence bowing problem of the silicon wafer, the proportions thereof can be decided based on actual requirements for each factory.

The aluminum powder is spherical in shape and preferably has an average particle diameter ranging from 3 μm to 8 μm. With the regular spherical-shaped aluminum powder, the packing density of a back electrode made from the conductive paste composition of this invention and the fill factor of a solar cell containing the back electrode can be improved.

FIG. 1 shows a method for producing the lead-free conductive paste composition of the present invention.

First, a mixture containing $Al_2O_3$, $SiO_2$, ZnO, $B_2O_3$, BaO, and $Bi_2O_3$ at an appropriate ratio is smelted in air at a temperature ranging from 900° C. to 1100° C. to form a homogeneous molten mixture, followed by water-quenching and grinding, thereby obtaining glass frits.

A mixture of aluminum and silicon at an appropriate ratio is smelted to form a homogeneous molten mixture and is atomized to give silumin powder with an average diameter ranging from 35 μm to 50 μm. More specifically, the mixture of aluminum and silicon is smelted using a vacuum induction melting furnace or a vacuum arc melting furnace at a temperature ranging from 1500° C. to 1650° C. and a pressure lower than $10^{-3}$ torr so as to obtain the homogeneous molten mixture. The homogeneous molten mixture is then atomized by impacting the same using an inert gas such as argon or nitrogen gas at a pressure of 20 to 30 atm to give silumin powder. The silumin powder is then cooled by natural cooling at room temperature or by blowing the same using highly-pressurized argon or nitrogen gas at a pressure of 20 to 30 atm. The silumin powder is then ground and sieved to obtain the powder having an average diameter ranging from 35 μm to 50 μm.

The lead-free conductive paste composition of the present invention is obtained by mixing the silumin powder, the glass frits, the organic binder, stearic acid zinc, and the aluminum powder at an appropriate ratio. Preferably, the organic binder containing PVB, EC, BC, BCA, and terpineol is preheated at a temperature ranging from 80° C. to 100° C. with stirring, followed by mixing with the silumin powder, the glass frits, stearic acid zinc, and the aluminum powder. The mixture is then ground and dispersed using a 3-roll kneader to give the conductive paste composition.

The conductive paste composition of this invention contains no lead and thus meets the EU RoHS Directive. Moreover, with the silumin powder, the bowing problem of the silicon wafer resulting from volume changes can be effectively reduced.

EXAMPLE 1

Based on the total weight of glass frits, 2 wt % of $Al_2O_3$, 9 wt % of $SiO_2$, 13 wt % of ZnO, 8 wt % of $B_2O_3$, 1 wt % of BaO, and the balance being $Bi_2O_3$ were well mixed in a mixer and were poured into a platinum crucible. The mixture in the platinum crucible was placed in a heating furnace at 950° C., and was then kept for 10 minutes after all oxides contained in the mixture were smelted completely to ensure that a homogeneous molten glass mixture was obtained. The molten glass mixture was quenched with water, and was ground to obtain the glass frits having a size less than 10 μm.

Based on the total weight of silumin powder, 75 wt % of silicon and 25 wt % of aluminum respectively obtained from silicon and aluminum briquettes with 99.99% purity were disposed in a crucible of a vacuum induction melting furnace. The furnace was evacuated to reduce the pressure therein to less than $10^{-3}$ torr, and was heated to 1600° C. The silicon and aluminum were smelted completely at this condition, and after 10 minutes, a molten silumin mixture was thus obtained. The molten silumin mixture was well mixed using a magnetic stirring device.

The molten silumin mixture was atomized by impacting the same using nitrogen gas at a pressure of 20 atm to give silumin powder, followed by cooling at room temperature.

Based on the total weight of an organic binder, 2 wt % of PVB, 5 wt % of EC, 25 wt % of BC, 25 wt % of BCA, and the balance being terpineol were mixed at 85° C. to give a clear and homogeneous organic binder.

Based on the total weight of a lead-free conductive paste composition, 2 wt % of the silumin powder, 2 wt % of the glass frits, 23 wt % of the organic binder, 0.5 wt % of stearic acid zinc, and the balance being the spherical-shaped aluminum powder with 99.8% purity were well mixed in a mixer for 40 minutes, and were then ground and dispersed in a 3-roll kneader to give a lead-free conductive paste composition having a particle size of less than 10 μm.

EXAMPLE 2

The method for preparing the lead-free conductive paste composition of Example 2 was similar to that of Example 1. The differences are described below.

In Example 2, the glass frits were composed of 1 wt % of $Al_2O_3$, 4 wt % of $SiO_2$, 14 wt % of ZnO, 9 wt % of $B_2O_3$, 2 wt % of BaO, and the balance being $Bi_2O_3$, and were heated at 1000° C. in a heating furnace. The silumin powder was composed of 55 wt % of silicon and 45 wt % of aluminum, and the pressure of the nitrogen gas used for atomizing the molten silumin mixture was 28 atm. The atomized silumin powder was cooled by blowing the same using 28 atm of nitrogen gas. The organic binder was composed of the components including 3 wt % of PVB, 4 wt % of EC, 10 wt % of BC, and 40 wt % of BCA, and the balance being terpineol, and the components were mixed in a container at 95° C. The lead-free conductive paste composition of Example 2 was composed of 3 wt % of the silumin powder, 4 wt % of the glass frits, 21 wt % of the organic binder, 0.2 wt % of stearic acid zinc, and the balance being the spherical-shaped aluminum powder.

COMPARATIVE EXAMPLE 1

The method for preparing the lead-free conductive paste composition of Comparative Example 1 was similar to that of Example 1, except that silumin powder was not included in the lead-free conductive paste composition of Comparative Example 1.

COMPARATIVE EXAMPLE 2

The method for preparing the lead-free conductive paste composition of Comparative Example 2 was similar to that of Example 2, except that silumin powder was not included in the lead-free conductive paste composition of Comparative Example 2.

[Test]

The lead-free conductive paste compositions in Examples 1 and 2 and in Comparative Examples 1 and 2 were used to form back electrodes on poly-silicon wafers so as to obtain test wafer samples A to D, respectively. The method for making the test wafer samples A to D is described below.

Each of the lead-free conductive paste compositions in the examples and comparative examples was screen printed onto a 156 mm×156 mm poly-silicon wafer coated with silver paste on the front side and the back side, followed by drying at 200° C. and firing so as to form a wafer back electrode on the poly-silicon wafer. The thickness of the bare wafer was 180 μm. The firing temperature was 850° C. in Example 1 and Comparative Example 1, and was 800° C. in Example 2 and Comparative Example 2.

In the test wafer sample A, the photoelectric conversion efficiency was 16.16%, the open-circuit voltage was 622 mV, the short circuit current was 8.23 A, and the fill factor was 76.8%. In the test wafer sample B, the photoelectric conversion efficiency was 16.02%, the open-circuit voltage was 619 mV, the short circuit current was 8.24 A, and the fill factor was 76.5%. The test wafer samples A and B containing the back electrodes made from the conductive paste compositions of the present invention passed the quality control tests.

Bowing phenomenon in each of the test wafer samples A to D was observed. The data is shown in Table 1.

TABLE 1

| Test wafer sample | A | B | C | D |
|---|---|---|---|---|
| Bowing (mm) | 1.39 | 1.01 | 1.98 | 1.65 |

As shown in Table 1, the bowing phenomenon in test wafer sample A was reduced by about 30% as compared with test wafer sample C, and the bowing phenomenon in test wafer sample B was reduced by about 39% as compared with test wafer sample D. The results reveal that the silumin powder contained in the lead-free conductive paste composition of the present invention can be used to effectively reduce the bowing phenomenon in the test wafer samples.

The lead-free conductive paste composition of the invention is entirely free of lead and no environmental issues attributed to lead metal will occur. With the inclusion of the silumin powder, the lead-free conductive paste composition of this invention is able to reduce the bowing phenomenon of a solar cell. The photoelectric conversion efficiency, the open-circuit voltage, the short circuit current, and the fill factor of the wafer sample also meet the industrial requirements.

While the present invention has been described in connection with what are considered the most practical and preferred embodiments, it is understood that this invention is not limited to the disclosed embodiments but is intended to cover various arrangements included within the spirit and scope of the broadest interpretation and equivalent arrangements.

What is claimed is:

1. A lead-free conductive paste composition, wherein, based on a total weight of said conductive paste composition, said lead-free conductive paste composition comprises 2 to 4 wt % of silumin powder, 2 to 3 wt % of lead-free glass frits, 21 to 23 wt % of organic binder, 0.2 to 0.5 wt % of stearic acid zinc, and the balance being aluminum powder.

2. The lead-free conductive paste composition of claim 1, wherein, based on the total weight of said silumin powder, said silumin powder comprises 12.6 to 99.9 wt % of silicon and the balance being aluminum powder.

3. The lead-free conductive paste composition of claim 1, wherein said lead-free glass frits comprise $Al_2O_3$, $SiO_2$, ZnO, $B_2O_3$, BaO, and $Bi_2O_3$.

4. The lead-free conductive paste composition of claim 1, wherein, based on the total weight of said organic binder, said organic binder comprises 1 to 4 wt % of polyvinyl butyral, 3 to 6 wt % of ethyl cellulose, 5 to 30 wt % of butyl carbitol, 20 to 45 wt % of butyl carbitol acetate, and the balance being terpineol.

5. The lead-free conductive paste composition of claim 1, wherein said aluminum powder is spherical in shape.

* * * * *